United States Patent [19]

Steinwart et al.

[11] 4,220,129

[45] Sep. 2, 1980

[54] FUEL INJECTION SYSTEM

[75] Inventors: Johannes Steinwart, Obersulm-Willsbach; Armin Bauder, Neckarsulm, both of Fed. Rep. of Germany

[73] Assignee: Audi NSU Auto Union Aktiengesellschaft, Neckarsulm/Württ, Fed. Rep. of Germany

[21] Appl. No.: 966,488

[22] Filed: Dec. 4, 1978

[30] Foreign Application Priority Data

Dec. 24, 1977 [DE] Fed. Rep. of Germany ..... 2757977

[51] Int. Cl.[3] ..... F02M 39/00; F01D 1/06

[52] U.S. Cl. ..... 123/457; 123/464; 123/505; 123/366; 261/50 A

[58] Field of Search ..... 123/139 AW, 140 MC, 123/139 BG, 139 ST, 140 FG, 179 G; 261/50 A

[56] References Cited

U.S. PATENT DOCUMENTS

| | | | |
|---|---|---|---|
| 2,618,222 | 11/1952 | Davies et al. | 123/140 MC |
| 3,894,523 | 7/1975 | Stumpp | 123/139 AW |
| 3,951,121 | 4/1976 | Passera et al. | 123/139 AW |
| 3,994,267 | 11/1976 | Eisele et al. | 123/139 AW |
| 4,090,487 | 5/1978 | Stumpp et al. | 123/139 AW |

*Primary Examiner*—Ira S. Lazarus
*Assistant Examiner*—Magdalen Moy
*Attorney, Agent, or Firm*—Kane, Dalsimer, Kane, Sullivan and Kurucz

[57] ABSTRACT

The fuel injection system for a mixture compressing externally ignited internal combustion engine includes a flow sensing member (3) arranged in an air intake duct (1), the member (3) moving in accordance with the quantity of air flowing through the duct so as to actuate a fuel dispensing valve (7) and to dispense a quantity of fuel to fuel injection nozzles (9) of the engine. The pressure difference in the dispensing valve (7) is maintained constant by means of a pressure sensitive valve (11) and a differential pressure control valve (20). The differential pressure control valve has two chambers (22 and 23) separated from each other by a rigid wall (21) and include diaphragms (24 and 25) arranged parallel to each other. The diaphragms are maintained at a fixed spacing from each other by a bolt (33) and both diaphragms are actuated by springs (37) and (42) which urge the diaphragms against each other. The loading stresses of the springs can be varied according to engine operating parameters and can be adjusted by devices for full load fuel concentration and cold-starting fuel concentration, and also a device responsive to air pressure chambers.

6 Claims, 1 Drawing Figure

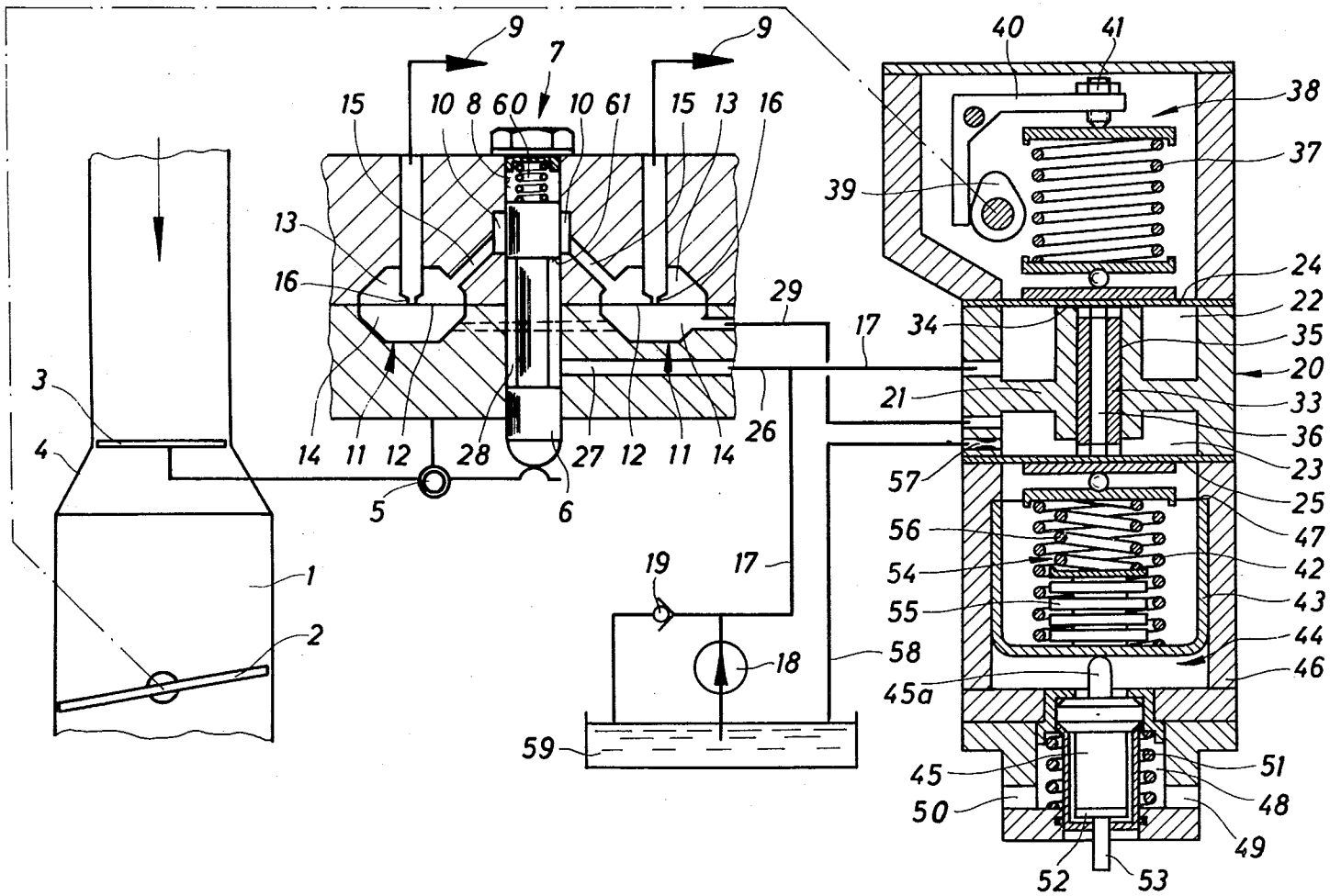
38
37
24
22
35
20
33
36
23
25
47
42
43
44
46
51
48
49
53
52
41
40
39
34
21
57
56
54
55
58
45a
45
50
17
29
26
16
13
15
61
10
7
60
8
9
14
11
12
27
6
28
5
18
19
59
1
2
3
4

FUEL INJECTION SYSTEM

The invention relates to a fuel injection system for a mixture compressing externally ignited internal combustion engine.

One known installation of this type (German Offenlegungsschrift No. 23 49 688) is so constructed that the differential pressure control valve and its first chamber is connected to an additional pressure control valve located in the back-flow pipeline and also to a further system pressure valve connected to the second chamber. The pressure control valve has a servomotor and its task is to control the pressure of the fuel flowing through in dependence upon motor characteristics. The disadvantage in this construction is that the differential pressure valve and pressure control valve occupy a comparatively large amount of space, are costly to manufacture, and dosing errors can occur as a result of the valves acting independently of each other.

The object of the invention is to produce a fuel injection system of this type having a differential pressure valve which is constructed in a compact and space-saving manner and ensures a reliable mode of operation.

Broadly stated, the invention consists in a fuel system for a mixture-compressing externally ignited internal combustion engine having continuous fuel injection, an air intake duct and an adjustable throttle valve in said intake duct, comprising a flow sensing element in said intake duct arranged to move in accordance with the quantity of air flowing through said intake duct and to actuate a fuel dispensing valve for dispensing a quantity of fuel substantially proportional or related to the quantity of air, means for maintaining a substantially constant pressure difference across the dispensing valve including a pressure sensitive valve with two chambers separated from one another by a movable partition element and a differential pressure control valve also having two separate chambers, the first chamber of said pressure sensitive valve being actuated by pressure downstream of the dispensing valve and communicating via a valve aperture with a fuel injection nozzle of the engine, whilst the second chamber of said pressure sensitive valve communicates with the first chamber of said differential pressure control valve, which chamber is connected to a return line, whilst the second chamber of the differential pressure control valve is actuated by the pressure upstream of the dispensing valve, the first chamber and the second chamber of the differential pressure control valve being separated from one another by a rigid barrier and including movable partition elements which are located parallel to each other and which are maintained at a fixed spacing from each other by a spacing member, the movable partition element of the second chamber controlling a valve aperture between the two chambers, both partition elements being actuated by resilient elements which urge said partition elements against each other, and whose loading stresses are variable, depending upon operating parameters. Preferably, the movable partition elements are diaphrams and the resilient elements are springs.

In accordance with the invention the first and the second chambers of the differential pressure control valve are separated from each other by a rigid wall or barrier and are defined by diaphragms located parallel to each other, which are maintained at a fixed spacing from each other by a bolt which penetrates the wall or barrier, and from which the diaphragm which defines the second chamber controls a valve aperture between the two chambers. Both diaphragms are actuated by springs which urge the diaphragms against one another, and whose loading stress can be varied in dependence upon operating parameters.

As a result of this a differential pressure control valve with a simple closed construction is produced, which has a small space requirement, and in contrast to the known construction, combines the function of differential pressure valve and pressure control valve.

Furthermore, several operating characteristics which influence the fuel dosing can act directly on the differential pressure control valve. A further advantage exists in that no leakage loss can occur as a result of the arrangement of two diaphragms according to the invention.

The springs can engage a device for full load fuel concentration, a device for cold-starting fuel concentration and a device which reacts to the air pressure, which vary the tension of the springs in such a way that the diaphragm defining the second chamber is actuated in the direction which closes the valve aperture, during a full load and with cold-starting, and in the direction which releases the valve aperture, when the air pressure falls. A differential pressure which produces a fuel dosing suited to the respective operating state can thereby be produced.

The device for full load concentration can rest against the spring of the diaphragm which defines the second chamber, and depending upon the position of the throttle valve with a full load, be movable in a direction which increases the loading stress of the spring. An increase in the pressure difference and therefore a higher fuel dosing can be obtained by the higher loading stress.

The device for cold-starting concentration can rest by means of a spring plate against the spring of the diaphragm which defines the first chamber and be movable in a direction which reduces the loading stress of the spring by means of an adjusting element which reacts to the engine temperature during cold-running. An increase in the pressure difference, and consequently a higher fuel dosing can occur in a similar way as a result of the lower loading stress of this spring. The engine temperature can, for example, be determined by measuring the cooling fluid temperature and/or the combustion chamber temperature.

The device which reacts to the air pressure can be located between the spring plate and the diaphragm which defines the first chamber, and be composed of a barometer case with a compression spring supported against it which with low air pressure, increases the tension between the spring plate and the diaphragm. As a result of this arrangement, a reduction of the pressure difference and therefore a smaller fuel dosing can be achieved. With a communication of the device which reacts to the air pressure with the air intake duct, the air pressure prevailing in the intake duct can act directly upon the barometer case, and the corresponding fuel dosing can therefore be regulated.

In order to avoid to a great extent frictional resistances which may possibly occur during the movement of the diaphragms, the bolt which penetrates the wall or barrier can project with lateral spacing freely through a longitudinal bore emanating from the valve aperture, through which the second and the first chambers are connected together when the diaphragm is removed from the valve aperture.

It is, however, also possible for the bolt penetrating the wall or barrier to be led in the longitudinal bore emanating from the valve aperture and to have a continuous duct, through which the second and the first chambers are connected together when the diaphragm is removed from the valve aperture. The bolt, in the case of this construction, can, for example, be slidably mounted or mounted with ball bearings.

The invention may be performed in various ways and one specific embodiment will now be described by way of example with reference to the accompanying drawing, which is a diagramatic view, partly in section, of a fuel injection system. Referring to the drawing, reference numeral 1 denotes an intake duct of a mixture-compressing externally ignited internal combustion engine, having an arbitrarily actuatable throttle valve 2 and contains a measuring member 3 which moves according to the quantity of air flowing through in the direction of the arrow. The measuring member 3 is constructed as a baffle plate and is located in a conical section 4 of the intake duct. The baffle plate 3 is pivotably mounted at 5 and acts upon the movable piston valve 6 of a fuel dosing valve 7. The piston valve 6 is located in a cylindrical bore 8, in whose wall a number of control slots corresponding to the number of injection nozzles 9 indicated by arrows, is provided. To each control slot 10 is connected a diaphragm valve 11, which has two chambers 13 and 14 separated from one another by a diaphragm 12. Each chamber 13 is in communication through a duct 15 with the relevant control slot 10 and through a valve aperture 16 controlled by the diaphragm 12, with the injection nozzle 9.

A differential pressure control valve 20 has two chambers 22 and 23 which are separated from each other by a rigid intermediate wall 21, and which are defined by diaphragms 24 and 25 located parallel to each other. The chamber 22 is charged through a pipeline 17 from an electrically driven fuel pump 18 with fuel under system pressure, which is determined by a system pressure retaining valve 19. A pipeline 26 branches off pipeline 17, and communicates through a duct 27 with an annular groove 28 in the piston valve 6 of the fuel dosing valve 7. The chamber 23 of the differential pressure control valve 20 is connected through a pipeline 29 to the second chambers 14 of all the diaphragm valves 11, and through a throttle point 57 and a return pipeline 58 to the fuel tank 59.

The diaphragms 24 and 25 are maintained by a bolt 33 at a fixed spacing from each other, where the diaphragm 24 controls a valve aperture 34 in the form of a flat seat valve, through which aperture the second chamber 22 and the first chamber 23 can be connected together. For this purpose, the bolt 33, which is housed in a longitudinal bore 35 extending from the valve aperture 34, has a continuous duct 36. The diaphragm 24, which defines the second chamber 22, is actuated by a spring 37, against which a device 38 for full load fuel concentration rests. The device 38 is essentially composed of a cam 39, which is movable depending upon the position of the throttle valve 2, by means of a rod system which is indicated diagrammatically by dot-dash lines, and of a transmission lever 40 with an adjusting screw 41, by which the action of the mutually pressing springs 37 and 42, is balanced. The diaphragm 25, which defines the first chamber 23, is actuated by the spring 42, whereby both diaphragms 24 and 25 are pressed against each other. Against the spring 42 rests a device 44 for cold-starting concentration, which, in this exemplified embodiment, is essentially composed of a thermoelement 45 and a spring plate 43, which is located between the latter and the spring 42 and is movable as far as an abutment surface 47. The thermoelement 45 is located in a chamber 48, through which cooling fluid flows via the connections 49 and 50, and can further expand by means of a spring 51 when the spring plate 43 has come into abutment at 47 during heating of the thermoelement. On the thermoelement 45 there is also fixed a heating element 52, which, in order to heat up, can be supplied with electric current via the contact 53. Between the spring plate 43 and the diaphragm 25 there is located a device 54 which reacts to the air pressure, and is composed of a barometer case 55 and an intermediate compression spring 56. The differential pressure control valve 20, together with the device 38 for full-load concentration, the device 44 for cold-starting concentration, and the device 54 responsive to the air pressure, forms a compact structural unit.

The pressure in the chamber 23, which determines the differential pressure at the dosing valve 7 is, controlled by the three devices 38, 44 and 54, which press against the diaphragms 24 and 25, and according to their position, release the valve aperture 34, through which a communication from the chamber 22 to the chamber 23 and from there through the pipeline 29 to the chambers 14 of each diaphragm part 11 is produced. By means of the adjusting screw 41, the prestress of the spring 37 and also the tension of the spring 42 and of the spring 56 can be so adjusted, that the differential pressure in the dosing valve 7 is obtained as necessary.

The fuel conveyed by the fuel pump 18 passes through the pipeline 17 into the chamber 22 of the differential pressure control valve 20, and also through the pipeline 26 and the duct 27 into the annular groove 28 of the piston valve 6. The piston valve 6 is moved upwards out of the resting position shown by the baffle plate 3, according to its deflection by the quantity of air flowing through the intake duct, against a counter-force which, in the exemplified embodiment, is created by a spring 60, whereby its control edge 61 releases the control slots 10, in proportion to the deflection of the baffle plate 3. The fuel consequently passes through the ducts 15 into the first chambers 13 of the diaphragm valves 11, from where it flows through the valve apertures 16 to the appropriate injection nozzles 9.

In order now to ensure that the quantity of fuel supplied to the injection nozzles 9 corresponds to the respective operating state of the internal combustion engine, the differential pressure is determined in dependence upon the three devices 38, 44 and 54, which vary the prestress of the springs 37, 42 and 56 which press against the diaphragms 24 and 25. A rotation of the cam 39 in dependence upon the position of the throttle valve 2 leads, for example, to an increase of the prestress of the spring 37 and in a direction which closes the valve aperture 34, and therefore to a fuel concentration with a full load. A fuel concentration during cold-running of the engine is achieved by retracting the pin 45*a* of the thermoelement 45, and reducing the loading stress of the spring 42. As a result of this, the diaphragm 24 is likewise actuated via the bolt 33 in a direction which closes the valve aperture 34. A decreasing fuel dosing when the air pressure falls occurs on account of the fact that the barometer case 55 expands and the tension between the spring plate 43 and the diaphragm 25 is increased via the spring 56, whereby the diaphragm 24 is actuated via the bolt 33 in a direction which opens the valve aperture 34. According to the operating state, there naturally arise intermediate positions under the influence of the various operating parameters, which produce a corresponding fuel dosing.

Many modifications of the exemplified embodiment shown are possible without departing from the framework of the invention. The cam 39 can, for example, be of such a shape as to make it possible for fuel reduction to follow fuel concentration with a full load, and for the spring 37 to be actuated in a direction which reduces its tension and the valve to be actuated in the opening direction. Furthermore, it is possible for the bolt 33 between the diaphragms 24 and 25 to project freely through the longitudinal bore 35 with lateral spacing, without touching the wall of the longitudinal bore, whereby a considerable reduction in friction, which produces functional security, is achieved.

The structural unit consisting of the differential pressure control valve 20 and the devices 38, 42 and 54, can, for example, be located directly on the intake duct 1, whereby direct coupling of the throttle valve 2 to the cam 39 is possible. In this case, a direct communication between the inner chamber of the housing 46 with the barometer case 55, and the intake duct 1 can also be produced, so that for example, when an internal combustion engine is supercharged, the fuel dosing is suited to the air pressure prevailing in the intake duct. In an internal combustion engine which is not supercharged, any soiling and clogging of the air filter which may possibly occur can have no detrimental effects on the fuel dosing through this communication, as the barometer case 55 equalizes the presssure variations caused thereby and transmits them to the dosing valve 7.

In a further modification of the exemplified embodiment, the thermoelement 45, as an adjusting element which reacts to the engine temperature, is replaced by an electrical or hydraulic servomotor, which is adjustable in dependence upon the combustion chamber temperature.

We claim:

1. A fuel system for a mixture-compressing internal combustion engine with spark ignition having a fuel injection nozzle for continuous fuel injection, an air intake duct and an adjustable throttle valve in said intake duct, comprising: a flow sensing element in said intake duct arranged to move in accordance with the quantity of air flowing through said intake duct; a fuel metering valve actuated by said flow sensing element for dispensing a quantity of fuel substantially proportional or related to the quantity of air; means for maintaining a substantially constant pressure difference across the metering valve including a pressure sensitive valve with two chambers separated from one another by a movable partition element, and a differential pressure control valve also having two separate chambers; the first chamber of said pressure sensitive valve being subject to the pressure downstream of the metering valve and comprising a first valve aperture controlled by the movable partition element and communicating with the fuel injection nozzle, while the second chamber of said pressure sensitive valve communicates with the first chamber of said differential pressure control valve; a return line connected to the first chamber of said differential pressure control valve, while the second chamber of the differential pressure control valve is subject to the pressure upstream of the metering valve; the first chamber and the second chamber of the differential pressure control valve being separated from one another by a rigid partition and being each delimited by a diaphragm, which diaphragms are located parallel to each other; a spacing member for maintaining the two diaphragms at a fixed spacing from each other; a second valve aperture between the two chambers controlled by the diaphragm delimiting the second chamber; and resilient elements which urge said diaphragms against each other and whose loading stresses are variable, depending upon operating parameters.

2. A fuel injection system according to claim 1, and further comprising a device for full load fuel enrichment, a device for cold-start fuel enrichment and a device responsive to the air pressure acting upon said resilient elements, said devices adjusting the loading stress of said resilient elements such that the diaphragms of the second chamber of the differential pressure control valve is actuated in the closing direction of said second valve aperture at full load and at cold-start and is actuated in the opening direction of said second valve aperture when the air pressure falls.

3. A fuel injection system according to claim 2, in which said device for full load enrichment rests against the resilient element acting upon the diaphragms of the second chamber of the differential pressure control valve and, depending upon the position of the throttle valve, is moved at full load for increasing the loading stress of said resilient element.

4. A fuel injection system according to claim 2, in which said device for cold-start enrichment rests against the resilient element acting upon the diaphragm of the first chamber, and comprises an adjusting element which is responsive to engine temperature for increasing the loading stress of said resilient element as the engine temperature increases, and in which a spring plate is provided between the resilient element and the adjusting element.

5. A fuel injection system according to claim 4, in which the device which reacts to the air pressure is located between said spring plate and the diaphragm of said first chamber, and comprises a bellows in series with a compression spring for increasing the loading on said diaphragm when the air pressure is low.

6. A fuel injection system according to claim 1, and further comprising a through bore in said rigid partition with said spacing member extending through said bore and having a continuous duct for connecting said second and the first chambers of the differential pressure control valve when the diaphragm delimiting the second chamber is removed from said second valve aperture.

* * * * *